US006499622B1

(12) United States Patent
Neiner

(10) Patent No.: US 6,499,622 B1
(45) Date of Patent: Dec. 31, 2002

(54) CAN LID CLOSURE AND METHOD OF JOINING A CAN LID CLOSURE TO A CAN BODY

(75) Inventor: Christopher G. Neiner, Defiance, MO (US)

(73) Assignee: Metal Container Corporation, Inc., St. Louis, MO (US)

( * ) Notice: Subject to any disclaimer, the term of this patent is extended or adjusted under 35 U.S.C. 154(b) by 0 days.

(21) Appl. No.: 09/456,345

(22) Filed: Dec. 8, 1999

(51) Int. Cl.[7] ..... B65D 6/28
(52) U.S. Cl. ..... 220/619; 220/623; 220/624
(58) Field of Search ..... 220/615, 619, 220/620, 623, 624

(56) References Cited

U.S. PATENT DOCUMENTS

| | | | |
|---|---|---|---|
| 3,843,014 A | 10/1974 | Cospen | |
| 3,983,827 A | 10/1976 | Meadors | 113/121 |
| 4,093,102 A | 6/1978 | Kraska | 220/67 |
| 4,217,843 A | 8/1980 | Kraska | 113/121 |
| 4,271,778 A | 6/1981 | La Bret | 113/121 |
| 4,448,322 A | 5/1984 | Kraska | 220/67 |
| 4,578,007 A | 3/1986 | Diekhoff | 413/6 |
| 4,606,472 A | 8/1986 | Taube | |
| 4,641,761 A | 2/1987 | Smith et al. | 220/66 |
| 4,674,649 A | 6/1987 | Pavely | |
| 4,735,863 A | 4/1988 | Bachmann et al. | 428/579 |
| 4,808,052 A | 2/1989 | Bulso, Jr. et al. | |
| 4,809,861 A | 3/1989 | Wilkinson | |
| 4,823,973 A | 4/1989 | Jewitt et al. | 220/67 |
| 4,893,725 A | 1/1990 | Ball | |
| 5,582,319 A | 12/1996 | Heyes et al. | |
| 5,911,551 A | 6/1999 | Moran | 413/31 |
| 6,126,034 A | 10/2000 | Borden et al. | 220/671 |

FOREIGN PATENT DOCUMENTS

| | | |
|---|---|---|
| DE | G 92 11 788 | 2/1993 |
| EP | 0 139 282 A2 | 5/1985 |
| EP | 0 340 955 B1 | 11/1989 |
| EP | 0 340 955 A1 | 11/1989 |
| GB | 2 196 891 A | 5/1988 |
| GB | 2 315 478 A | 11/1996 |
| JP | 5 185170 | 7/1993 |

OTHER PUBLICATIONS

WO 96/37414; International Application Published by the World Intellectual Property Organization; Nov. 28, 1996; PCT/GB96/00709; Carnaudmetalbox plc; Great Britain.
WO 98/34743; International Application Published by the World Intellectual Property Organization; Aug. 13, 1998; PCT/GB98/00243; Crown Cork & Seal Technologies Corporation; United States.
JP S57–117323; Japanese Utility Model Application; Jan. 12, 1981; Toyo Seikan, Co. Ltd.
WO 00/12243; International Application Published by the World Intellectual Property Organization; Mar. 9, 2000; PCT/US99/18944; Crown Cork & Seal Technologies Corporation; United States.

*Primary Examiner*—Joseph M. Moy
(74) *Attorney, Agent, or Firm*—Storm & Hemingway LLP; Paul V. Storm; Dawn C. Wolff

(57) ABSTRACT

A preferred embodiment of the disclosed can lid has a center panel having a central axis that is perpendicular to a diameter of the outer rim, or peripheral curl portion, of the can lid, an annular countersink surrounding the center panel, an arcuate chuckwall extending radially outward from the annular countersink, an arcuate step portion extending radially outward from the arcuate chuckwall, a transitional portion extending radially outward from the arcuate step portion, and a peripheral curl portion extending outwardly from the transitional portion.

15 Claims, 3 Drawing Sheets

CAN LID CLOSURE AND METHOD OF JOINING A CAN LID CLOSURE TO A CAN BODY

TECHNICAL FIELD

The present invention relates generally to metal containers, and more particularly to metal cans.

BACKGROUND OF THE INVENTION

Aluminum cans are used primarily as containers for retail sale of beverages in individual portions. Annual sales of such cans are in the billions and consequently, over the years, their design has been refined to reduce cost and improve performance. Other refinements have been made for ecological purposes, to improve reclamation and promote recycling.

Cost reductions may be realized in material savings, scrap reduction and improved production rates. Performance improvements may be functional in nature, such as better sealing and higher ultimate pressure capacity. Such improvements can allow the use of thinner sheet metal, which leads directly to material cost reductions. Performance improvements may also be ergonomic in nature, such as a can end configured to allow for easier pull tab access or better lip contact.

Aluminum cans are usually formed from a precoated aluminum alloy, such as the aluminum alloy 5182. The cans, which are typically made from relatively thin sheet metal, must be capable of withstanding pressures approaching 100 psi., with 90 psi being an industry recognized requirement. The cans are usually formed from a can body to which is joined a can lid or closure. Each of these components has certain specifications and requirements. For instance, the upper surface of the can lids must be configured to nest with the lower surface of the can bottoms so that the cans can be easily stacked one on top of the other. It is also desirable to have the can lids themselves nest with each other in a stacked arrangement for handling and shipping purposes prior to attaching the can lid to the can body. The ability to satisfy these functional requirements with the use of ever less material continues to develop.

A prior art disclosure, published under the Patent Cooperation Treaty in International Publication Number WO 96/37414, discloses can lid design for reduced metal usage and improved pressure capability. This can lid comprises a peripheral portion or "curl," a frustroconical chuckwall depending from the interior of the peripheral curl, an outwardly concave annular reinforcing bead or "countersink" extending radially inwards from the chuckwall, and a center panel supported by the inner portion of the countersink. The frustroconical chuckwall is inclined at an angle of between 20° and 60° with respect to an axis perpendicular to the center panel. A double seam is formed between this can end and a can body by a process wherein the peripheral curl is centered on the can body flange by a frustroconical/cylindrical chuck designed to fit into the frustroconical chuckwall of the can lid. The overlap of the peripheral curl on the lid with the can body flange is described to be by a conventional amount. Rotation of the can lid/can body, first against a seaming roll and then a flattening roll completes a double seam between the two parts. During the flattening operation, the portion of the chuckwall adjacent to the peripheral curl is bent to a cylindrical shape and flattened against the cylindrical surface of the chuck. The lid of International Publication Number WO 96/37414 incorporates known dimensions for the peripheral curl portion which is seamed to the can.

The can lid disclosed in International Publication Number WO 96/37414 requires a greater amount of metal than the can lid of the present invention, thereby increasing the manufacturing costs. The increased metal usage in this prior art stems from a higher, or deeper, countersink, a larger peripheral curl portion than is disclosed in the present invention and the use of a frustroconical chuckwall that is characterized by a single angle with respect to an axis perpendicular to the central panel. The can lid disclosed in WO 96/37414 is also susceptible to increased metal deformation during seaming and failure at lower pressures.

SUMMARY OF THE INVENTION

The present invention contemplates improved aluminum can lids combining a slanted chuckwall with a reduced seam. A preferred embodiment of the disclosed can lid has a center panel having a central axis that is perpendicular to a diameter of the outer rim of the can lid, an annular countersink extending radially outward from the center panel, an arcuate chuckwall extending radially outward from the annular countersink, a step portion, a transitional portion extending radially outward from the chuckwall, and a peripheral curl extending outwardly from the transitional portion. The step portion improves the consistency and integrity of a double seam formed between the can lid and the can body while the arcuate chuckwall improves the strength of the can lid as compared to a simple frustroconical chuckwall. These features reduce metal usage in manufacturing and are expected to reduce filled can failures, and allow the use of thinner sheet metal for the can lid.

BRIEF DESCRIPTION OF THE DRAWINGS

The accompanying drawings are incorporated into and form a part of the specification to assist in explaining the present inventions. The drawings are intended for illustrative purposes only and are not intended as exact representations of the embodiments of the present inventions. The drawings further illustrate preferred examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
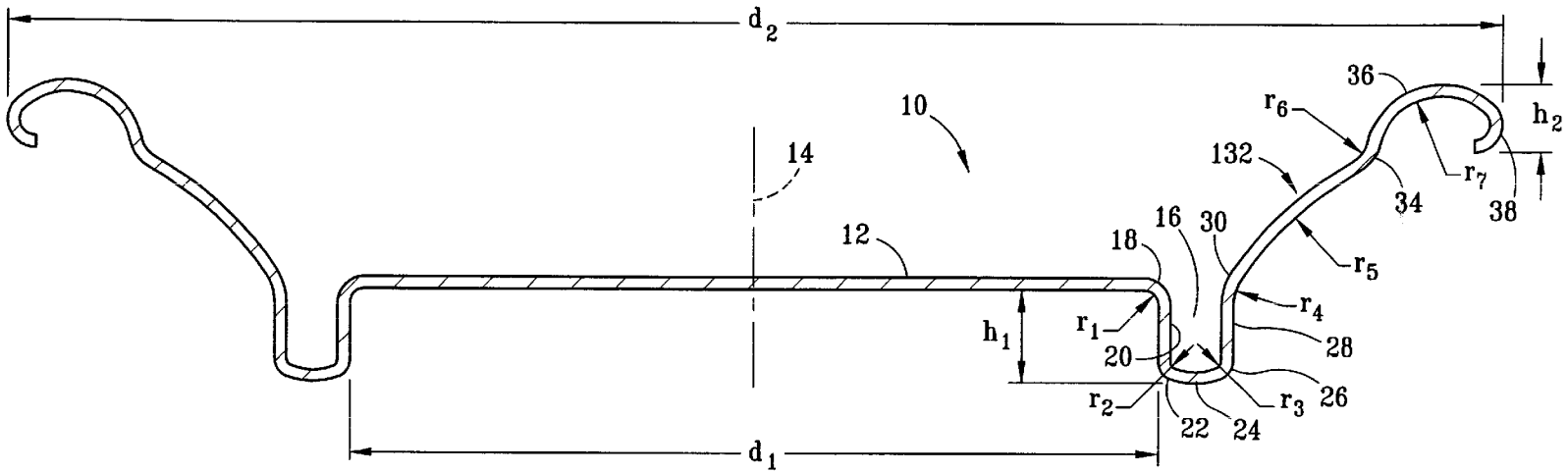
FIG. 1 shows an elevational cross-sectional view of a can lid constructed in accordance with the invention.

The present inventions are described in the following text by reference to drawings of examples of how the inventions can be made and used. The drawings are for illustrative purposes only and are not exact scale representations of the embodiments of the present inventions. In these drawings, the same reference characters are used throughout the views to indicate like or corresponding parts. FIG. 1 illustrates one preferred embodiment of can lid 10. The embodiments shown and described herein are exemplary. Many details are well known in the art, and as such are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made, especially in matters of arrangement, shape and size of the parts, within the principles of the invention to the full extent indicated by the broad general meaning of the terms used in the claims. The dimensions provided in the description are tooling dimensions and the actual dimensions of can lids manufactured in accordance with the present invention may vary.

FIG. 1 is a cross-section view of a can lid 10, illustrative of a preferred embodiment of the present inventions. Can lid 10 is preferably made from aluminum sheet metal. Typically, an aluminum alloy is used, such as aluminum alloy 5182. The sheet metal typically has a thickness of from about 0.080 to about 0.100 inches, more preferably from about 0.082 to about 0.094 inches, and still more preferably from about 0.084 to about 0.088 inches. The sheet metal may be coated with a coating (not shown) on at least one side. This coating is usually provided on that side of the sheet metal that will form the interior of the can. Can lids are usually formed in a multi-step operation. Those skilled in the art will be well acquainted with such methods of forming can lids to provide the configuration and geometry of the can lid 10 as described herein.

The can lid 10 has a center panel 12. The center panel 12 is generally circular in shape but may be intentionally noncircular. The center panel 12 may have a diameter $d_1$ of from about 1.5 to about 2 inches, more preferably from about 1.6 to about 1.9 inches, and still more preferably from about 1.7 to about 1.8 inches. Although the center panel 12 is shown as being flat, it may also have a peaked or domed configuration as well, and is not necessarily limited to the flat or planar configuration. The center panel 12 has a central axis 14 that is perpendicular to a diameter $d_2$ of the outer rim, or peripheral curl portion 38, of can lid 10. The diameter $d_1$ of center panel 12 is preferably less than 80% of the diameter $d_2$ of the outer rim, or peripheral curl portion 38, of can lid 10.

Surrounding the center panel is an annular countersink 16 that is formed from an interior wall 20 and an exterior wall 28, which are spaced apart and joined together by a curved bottom portion 24. The inner and outer walls 20, 28 are generally flat and may be parallel to one another or at a slight angle, with the bottom portion 24 being curved. The inner and outer walls 20, 28 are preferably parallel to central axis 14 but either or both may diverge by an angle of about as much as 15°. The annular counter sink 16 is joined to the center panel 12 along the upper edge of the interior wall 20. The curved juncture 18 joining interior wall 20 and edge of the center panel 12 has a radius of curvature $r_1$, that is from about 0.013 to about 0.017 inches, more preferably from about 0.014 to about 0.016 inches, and still more preferably from about 0.1425 to about 0.01525 inches, though this radius of curvature $r_1$ is not considered critical. The center-point of radius of curvature $r_1$ is located below the profile of can lid 10. Interior wall 20 is joined to bottom portion 24 by curved juncture 22 having a radius of curvature $r_2$. Radius of curvature $r_2$ is from about 0.006 to about 0.018 inches, more preferably from about 0.009 to about 0.015 inches, and still more preferably from about 0.011 to about 0.013 inches, though radius of curvature $r_2$ is not considered critical. The center-point of radius of curvature $r_2$ is located above the profile of can lid 10. Bottom portion 24 is joined to outer wall 28 by curved juncture 26, having a radius of curvature $r_3$ that is from about 0.010 to about 0.022 inches, more preferably from about 0.012 to about 0.020 inches, and still more preferably from about 0.014 to about 0.018 inches. Radius of curvature $r_3$ has a center-point located above the profile of can lid 10 and is also not considered critical. The annular countersink 16 has a height $h_1$ of from about 0.03 to about 0.115 inches, more preferably from about 0.05 to about 0.095 inches, and still more preferably from about 0.06 to about 0.085 inches.

The annular countersink 16 is joined to chuckwall 132 by curved juncture 30 having a radius of curvature $r_4$ of from about 0.03 to about 0.07 inches, more preferably from about 0.035 to about 0.06 inches, and still more preferably from about 0.0375 to about 0.05 inches, though not considered critical. The center-point of radius of curvature $r_4$ is located below the profile of can lid 10. Chuckwall 132 is shown as an arcuate chuckwall having a radius of curvature $r_5$ that is from about 0.4 to about 1 inch, more preferably from about 0.520 to about 0.845 inches, still more preferably from about 0.620 to about 0.745 inches, and most preferably from about 0.670 to about 0.695 inches. The center-point of radius of curvature $r_5$ is located below the profile of can lid 10. The arcuate chuckwall 132 is such that a line passing through the innermost end of arcuate chuckwall 132, near the terminus of curved juncture 30, and the outermost end of the arcuate chuckwall 132, near the beginning of step portion 34, forms an acute angle with respect to central axis 14 of the center panel 12. This acute angle is from about 20° to about 80°, and more preferably from about 30° to about 60°, and still more preferably from about 40° to about 50°.

The step portion 34 extends radially outward from the arcuate chuckwall 132. Step portion 34 is preferably curved with a radius of curvature $r_6$ of from about 0.02 to about 0.06 inches, more preferably from about 0.025 to about 0.055 inches, still more preferably from about 0.03 to about 0.05 inches, and most preferably from about 0.035 to about 0.045 inches. The radius of curvature $r_6$ has a center-point located above the profile of the can lid 10.

Transitional portion 36 extends radially outward from step portion 34. Transitional portion 36 has a radius of curvature $r_7$ of from about 0.04 to about 0.09 inches, more preferably from about 0.05 to about 0.08 inches, and still more preferably from about 0.06 to about 0.07 inches. Radius of curvature $r_7$ has a center-point located below the profile of can lid 10. Peripheral curl portion 38 extends radially outward from transitional portion 36. Peripheral curl portion 38 has a height $h_2$ of from about 0.04 to about 0.09 inches, more preferably from about 0.0475 to about 0.0825 inches, still more preferably from about 0.055 to about 0.075 inches, and most preferably from about 0.06 to about 0.07 inches.

Figure 2:
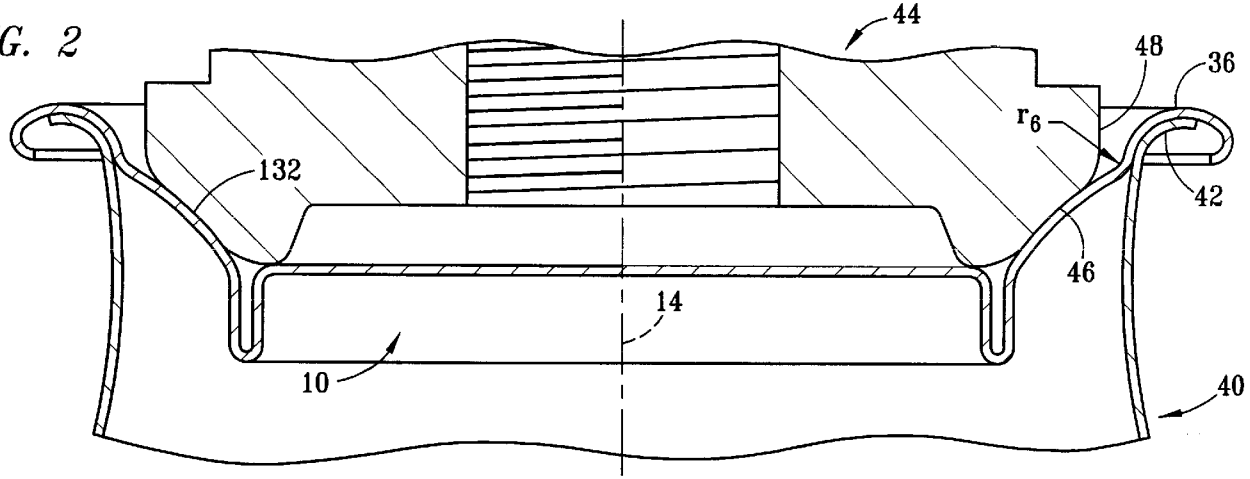
FIG. 2 shows an elevational cross-sectional view of a can lid on a can body before forming of a double seam.

FIG. 2 shows the same embodiment of can lid 10 as FIG. 1 with the exception of chuckwall 132. Chuckwall 232 in FIG. 2 is not an arcuate chuckwall but is generally flat or planar from a cross-sectional view. Chuckwall 232 has no radius of curvature. Chuckwall 232 is inclined at an angle with respect to central axis 14 of from about 20° to about 80°, and more preferably of from about 30° to about 60°, and still more preferably from about 40° to about 50°.

Transitional portion 36 extends radially outward from chuckwall 132 as opposed to extending radially outward from step portion 34 when the can lid has no step portion 34. Chuckwall 132 is connected to peripheral curl portion 38 by transitional portion 36.

FIG. 2 shows can lid 10 resting on can body 40, and particularly resting on flange 42 of can body 40. Can body 40 is supported by a base plate 45 (not shown) which together with chuck 44 is mounted for rotation about axis 14. Chuck 44 includes a driving surface 46 configured to match and engage with the surface of chuckwall 132 and with radius of curvature $r_6$. Chuck 44 includes a substantially cylindrical upper portion 48. As discussed below, upper portion 48 may be modified by a draft angle for production purposes. A limited clamping force between chuck 44 and base plate 45 (not shown) provides adequate friction between chuck 44 and chuckwall 132 for positive rotation of can lid 10 and can body 40.

Figure 3:
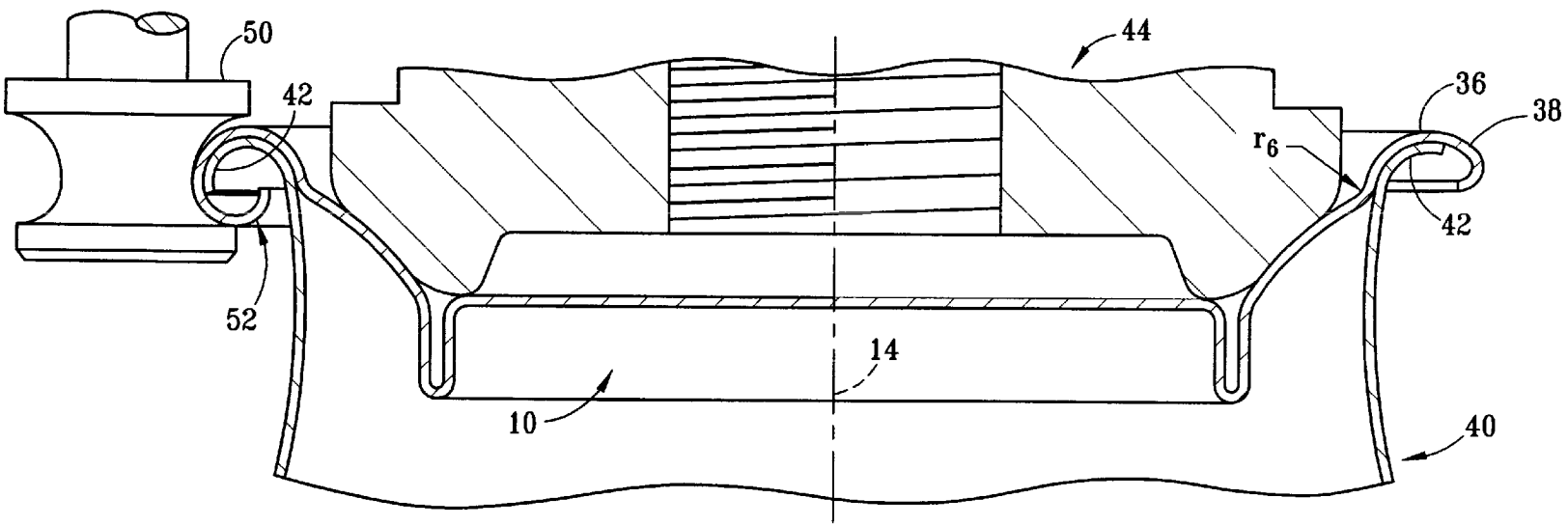
FIG. 3 shows an elevational cross-sectional view of a can lid on a can body as it appears during the first step of forming a double seam.

FIG. 3 shows the initial stage of double seam formation between can lid 10 and can body 40. Roller 50 bears against peripheral curl portion 38 and the centering force exerted by chuck 44. Chuck 44 drives can lid 10 and can body 40 to rotate, generating a rolling, swaging action that reforms transitional portion 36, peripheral curl portion 38, and flange 42 into an intermediate peripheral seam 52. Radius of curvature $r_6$ bears against chuck 44 to support transitional portion 36 and peripheral curl portion 38 leads the rolling deformation against roller 50. Thus positive support and guidance work together to achieve consistent and reliable results in producing intermediate peripheral seam 52.

Figure 4:
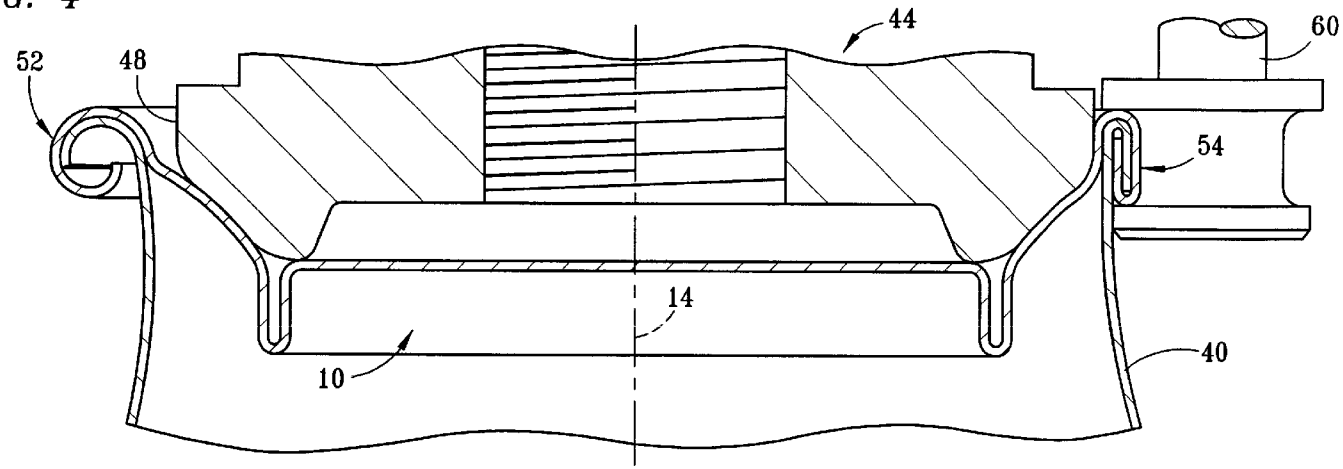
FIG. 4 shows an elevational cross-sectional view of a can lid on a can body as it appears during the final step of forming a double seam.

FIG. 4 shows the final stage of forming a double seam between can lid 10 and can body 40. Here, roller 60 bears against intermediate peripheral seam 52 as it is supported by chuck 44. Chuck 44 drives can lid 10 and can body 40 to rotate, so that the pressure of roller 60 flattens intermediate peripheral seam 52 against upper portion 48 of chuck 44, producing double seam 54. Upper portion 48 of chuck 44 may be modified to include a draft angle for ease of separation of can lid 10 after this operation.

Figure 5:
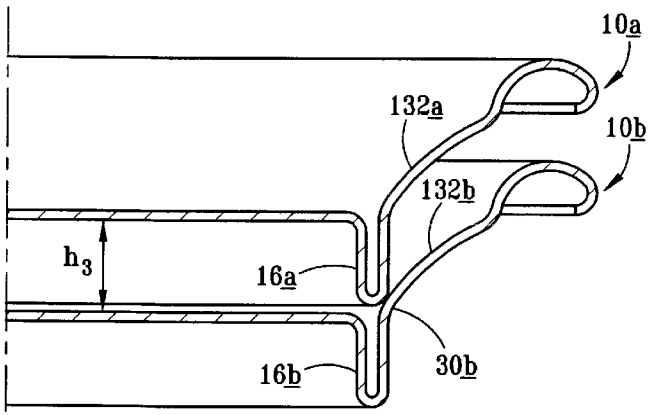
FIG. 5 shows an elevational cross-sectional view of the manner of stacking can lids constructed in accordance with the invention.

FIG. 5 shows the manner in which a plurality of can lids 10 stack for handling, packaging, and feeding a seaming machine. Annular countersink 16*a* of can lid 10*a* bears down against chuckwall 132*b* near curved juncture 30*b* of adjacent can lid 10*b*. Can lid 10*a* is supported and separated from can lid 10*b* by a height $h_3$ sufficient to accommodate the thickness of a pull-tab (not shown). In this manner, can lids 10 are compactly and efficiently handled and are more readily positioned for magazine feeding of a mechanized seaming operation.

Figure 6:
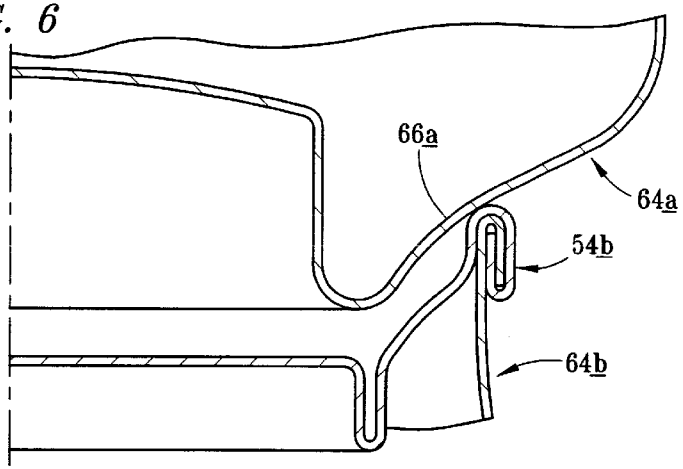
FIG. 6 shows an elevational cross-sectional view of the manner of stacking filled cans of the present inventions.

FIG. 6 shows the manner of stacking filled can 64*a,* closed and sealed according to the present invention on a like filled can 64*b*. Stand bead 66*a* rests upon double seam 54*b*.

The following table indicates model test results on buckle pressures for a prior art can lid and an embodiment of the present invention. The buckle pressure is the pressure at which a sealed can experiences seam failure. The industry standard for minimum acceptable buckle pressure is around 90 psi. This table is based solely on model results and is included for illustrative purposes only. These model results indicate that implementation of an embodiment of the present invention will result in obtaining a buckle pressure no worse than a prior art can lid.

| CAN LID | BUCKLE PRESSURE (PSI) |
|---|---|
| Prior Art Can Lid With Mini Seam and Nonarcuate Chuckwall | Basis |
| Can Lid of FIG. 1 With Reduced Seam Peripheral Curl, Arcuate Chuckwall, and Step Portion | 4 psi above basis |

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad meaning of the terms of the attached claims.

The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. A lid for a can body comprising:

a center panel having a central axis that is perpendicular to a diameter of the outer rim of said lid;

an annular countersink surrounding said center panel;

an arcuate chuckwall extending radially outward from said annular countersink, wherein a line passing through the ends of said chuckwall is at an angle with respect to said central axis of the center panel of from about 20° to about 80°; and a peripheral curl portion having a height less than 0.091 inches extending radially outward from said chuckwall.

2. The can lid according to claim 1 wherein a line passing through the ends of said chuckwall is at an angle with respect to said central axis of the center panel of from about 30° to about 60°.

3. The can lid according to claim 1 wherein a line passing through the ends of said chuckwall is at an angle with respect to said central axis of the center panel of from about 40° to about 50°.

4. The can lid according to claim 1 wherein the height of said peripheral curl portion is from about 0.04 to about 0.09 inches.

5. The can lid according to claim 1 further comprising a transitional portion extending radially outward from said chuckwall, wherein the peripheral curl portion extends radially outward from said transitional portion.

6. The can lid according to claim 1 wherein said center panel is substantially flat or planar.

7. The can lid according to claim 1 wherein said center panel is arcuate.

8. The can lid according to claim 1 wherein said arcuate chuckwall has a radius of curvature of from about 0.4 to about 1 inch, the center-point of said radius located below the profile of said lid.

9. The can lid according to claim 1 further comprising a step portion extending radially outward from said chuckwall.

10. The can lid according to claim 9 wherein said step portion is arcuate.

11. The can lid according to claim 10 wherein said arcuate step portion has a radius of curvature of from about 0.02 to about 0.06 inches, the center-point of said radius being located above the profile of said lid.

12. The can lid according to claim 1 wherein said annular countersink has a height of from about 0.030 to about 0.115 inches.

13. A lid for a can body comprising:

a center panel having a central axis that is perpendicular to a diameter of the outer rim of said lid;

an annular countersink surrounding said center panel;

an arcuate chuckwall extending radially outward from said annular countersink, wherein a line passing through the ends of said chuckwall is at an angle with respect to said central axis of the center panel of from about 20° to about 80°;

a step portion extending radially outward from said chuckwall;

a transitional portion extending radially outward from said step portion; and a peripheral curl portion having a height less than 0.091 inches extending radially outward from said transitional portion.

14. The lid according to claim 13 wherein said step portion is an arcuate step portion.

15. A lid for a can body comprising:

a center panel having a central axis that is perpendicular to a diameter of the outer rim of said lid;

an annular countersink surrounding said center panel wherein said annular countersink has a height of from about 0.030 to about 0.115 inches;

an arcuate chuckwall extending radially outward from said annular countersink wherein said arcuate chuckwall has a radius of curvature of from about 0.4 to about 1 inch, the center-point of said radius being located below the profile of said lid, and wherein a line passing through the ends of said arcuate chuckwall is at an angle with respect to said central axis of the center panel of from about 20° to about 80°;

an arcuate step portion extending radially outward from said arcuate chuckwall wherein said arcuate step portion has a radius of curvature of from about 0.02 to about 0.06 inches, the center-point of said radius being located above the profile of said lid;

a transitional portion extending radially outward from said arcuate step portion; and a peripheral curl portion extending radially outward from said transitional portion wherein said peripheral curl portion has a height less than 0.091 inches.

* * * * *

UNITED STATES PATENT AND TRADEMARK OFFICE

CERTIFICATE OF CORRECTION

PATENT NO. : 6,499,622 B2 
DATED : December 31, 2002
INVENTOR(S) : Edward P. Coleman, James E. Colley and Patrick M. O'Donnell It is certified that error appears in the above-identified patent and that said Letters Patent is hereby corrected as shown below:

Column 5,
Lines 27-28, "FIG. 1" should read -- FIG. 1 (comprising FIGS. 1A and 1B) --.

Column 11,
Line 11, "mi, 18" in relation" should read -- mil, 18" in relation --.

Column 12,
Lline 54, "claim 4" should read -- claim 3 --.

Signed and Sealed this

Sixteenth Day of March, 2004

JON W. DUDAS
*Acting Director of the United States Patent and Trademark Office*